US011294300B2

(12) United States Patent
Maezawa

(10) Patent No.: US 11,294,300 B2
(45) Date of Patent: Apr. 5, 2022

(54) DEVELOPMENT DEVICE AND IMAGE FORMING APPARATUS INCLUDING THE DEVELOPMENT DEVICE

(71) Applicant: KYOCERA Document Solutions Inc., Osaka (JP)

(72) Inventor: Nobuhiro Maezawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/373,076

(22) Filed: Jul. 12, 2021

(65) Prior Publication Data

US 2022/0019155 A1 Jan. 20, 2022

(30) Foreign Application Priority Data

Jul. 17, 2020 (JP) ..... JP2020-123083

(51) Int. Cl.
*G03G 15/08* (2006.01)

(52) U.S. Cl.
CPC ..... *G03G 15/0812* (2013.01); *G03G 15/0808* (2013.01)

(58) Field of Classification Search
None
See application file for complete search history.

(56) References Cited

U.S. PATENT DOCUMENTS

2001/0036376 A1* 11/2001 Yamazaki ..... G03G 15/0808 399/281
2003/0219285 A1* 11/2003 Nakagawa ..... G03G 15/081 399/281
2009/0003863 A1* 1/2009 Hagiwara ..... G03G 15/0808 399/58
2013/0236217 A1* 9/2013 Nagatomo ..... G03G 9/08 399/281
2020/0333726 A1* 10/2020 Mukai ..... G03G 15/0812

FOREIGN PATENT DOCUMENTS

| | | | | |
|---|---|---|---|---|
| JP | H05-257375 | A | 10/1993 | |
| JP | H08272138 | A | * 10/1996 | |
| JP | 3104007 | B2 | 10/2000 | |
| JP | 2002023432 | A | * 1/2002 | ..... G03G 15/0806 |
| JP | 2009042566 | A | * 2/2009 | |
| JP | 2009058736 | A | * 3/2009 | |
| JP | 2009271415 | A | * 11/2009 | |
| JP | 2010079010 | A | * 4/2010 | |
| KR | 20200123031 | A | * 10/2020 | |

* cited by examiner

*Primary Examiner* — Sevan A Aydin
(74) *Attorney, Agent, or Firm* — Studebaker & Brackett PC

(57) ABSTRACT

A development device includes a development housing, a development roller, a supply roller and a layer thickness regulating member. The development housing stores a non-magnetic one-component toner. The development roller is formed by a cylindrical elastic body. The supply roller includes a metal shaft member and a cylindrical foamed elastic body, and supplies the toner to the development roller and collects the toner from the development roller. The supply roller has an electric resistance within a range of $1\times10^2\Omega$ or more and $1\times10^4\Omega$ or less. The supply roller comes into contact with the circumferential face of the development roller in a state where a compression load within a range of 0.2 N or more and 1.5 N or less is applied to the shaft member of the supply roller in a direction perpendicular to an axial direction of the shaft member.

6 Claims, 3 Drawing Sheets

DEVELOPMENT DEVICE AND IMAGE FORMING APPARATUS INCLUDING THE DEVELOPMENT DEVICE

INCORPORATION BY REFERENCE

This application is based on and claims the benefit of priority from Japanese patent application No. 2020-123083 filed on Jul. 17, 2020, which is incorporated by reference in its entirety.

BACKGROUND

The present disclosure relates to a development device which develops an electrostatic latent image formed on a photosensitive drum by a non-magnetic one-component developer, and an image forming apparatus including the development device.

An image forming apparatus such as a printer includes a development device which develops an electrostatic latent image formed on a photosensitive drum by a non-magnetic one-component developer. In such a development device, by setting compression set of a supply roller supplying a toner to a development roller and compressed amount of the supply roller on the development roller within the respective predetermined ranges, stress applied to the toner is reduced, and image failures such as toner fogging are decreased.

Further, by forming a large number of holes on the surface of the elastic supply roller and setting the inner diameter of the hole so as to become narrower toward the radially inner side, the toner is prevented from entering into the inner portions of the holes, and elastic deterioration of the supply roller due to an aggregation of the toner in the holes is suppressed.

However, even when the compressed amount of the supply roller to the development roller is set within the predetermined range, when high density images (solid images) are continuously printed, it is difficult to supply a sufficient amount of the toner from the supply roller to the development roller, and as a result, there is a problem that image failures such as insufficiency of the image density and density unevenness are likely to occur due to a failure in following performance. In addition, when the inner diameter of the hole formed on the surface of the supply roller is made narrower toward the radially inner side, because an amount of the toner stored in the supply roller is small, when solid images are continuously printed, a sufficient amount of the toner cannot be supplied from the supply roller to the development roller, and similarly, there is a problem that image failures such as insufficiency of the image density and density unevenness are likely to occur due to a failure in following performance.

SUMMARY

In accordance with an aspect of the present disclosure, a development device includes a development housing, a development roller, a supply roller and a layer thickness regulating member. The development housing stores a non-magnetic one-component toner. The development roller is formed by a cylindrical elastic body, is supported by the development housing in a rotatable manner, is disposed so as to face a photosensitive drum at a development nip area, and has a circumferential face on which the toner is carried. The supply roller includes a metal shaft member and a cylindrical foamed elastic body provided around the shaft member, is supported by the development housing in a rotatable manner, comes into contact with the circumferential face of the development roller to form a supply nip area between the supply roller and the development roller, supplies the toner to the development roller and collects the toner from the development roller. The layer thickness regulating member comes into contact with the circumferential face of the development roller on a downstream side of the supply nip area in a rotational direction of the development roller and regulates a thickness of the toner on the development roller. The supply roller has an electric resistance within a range of $1\times10^2\Omega$ or more and $1\times10^4\Omega$ or less. The supply roller comes into contact with the circumferential face of the development roller in a state where a compression load within a range of 0.2 N or more and 1.5 N or less is applied to the shaft member of the supply roller in a direction perpendicular to an axial direction of the shaft member.

In accordance with an aspect of the present disclosure, an image forming apparatus includes the development device and the photosensitive drum having a surface on which an electrostatic latent image is formed, and to which the toner is supplied from the development roller.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
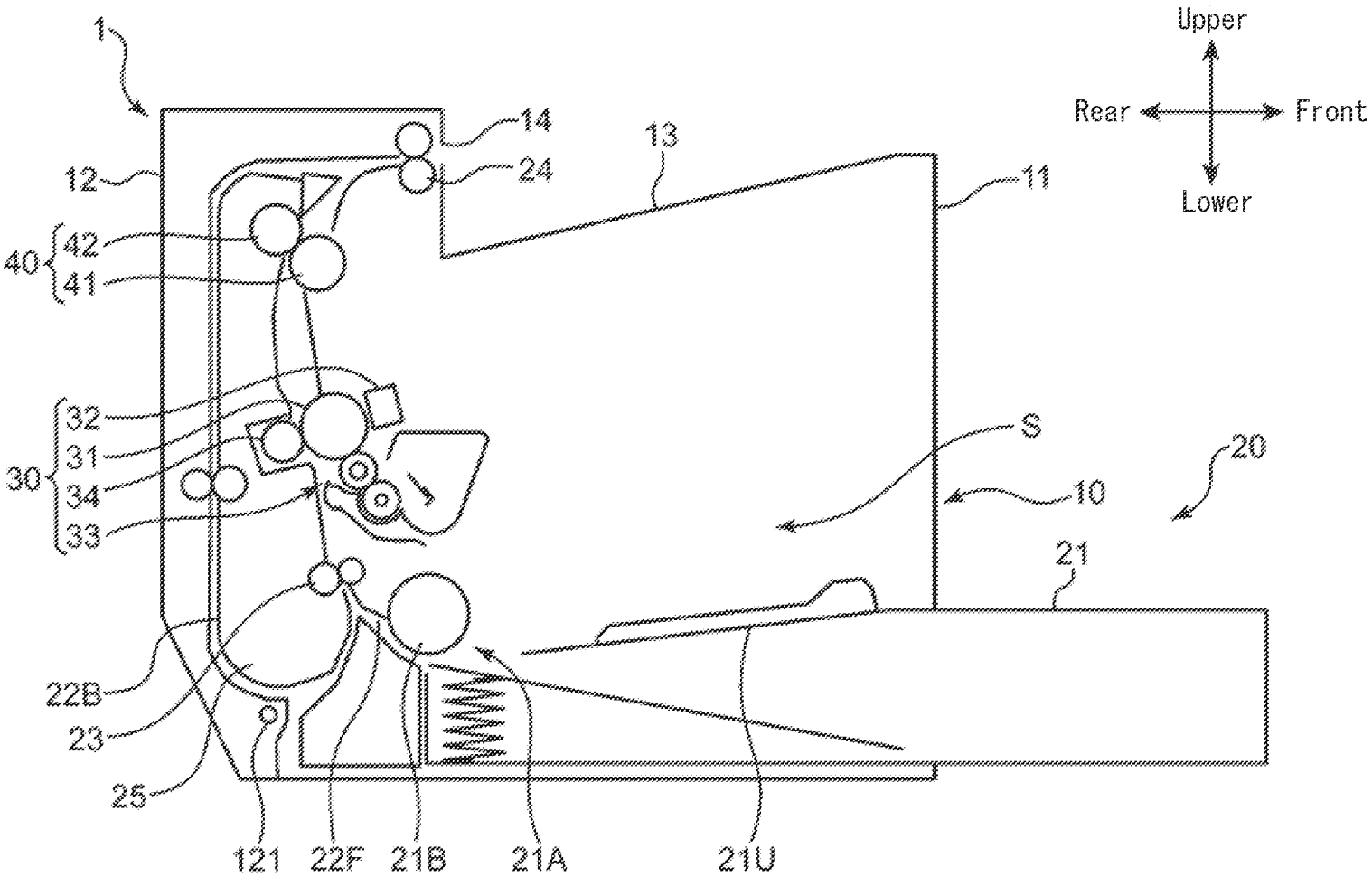
FIG. 1 is a sectional view showing an inner structure of an image forming apparatus according to one embodiment of the present disclosure.

Hereinafter, with reference to the attached drawings, an embodiment of the present disclosure will be described. FIG. 1 is a sectional view showing an inner structure of an image forming apparatus 1 according to the embodiment of the present disclosure. Here, a monochrome printer is shown as an example of the image forming apparatus 1, but the image forming apparatus may be a copying machine, a facsimile machine, a multifunctional peripheral containing function of these machines, or a full color image forming apparatus.

The image forming apparatus 1 includes a main housing 10 having an approximately parallelepiped shaped casing structure, a sheet feeding part 20, an image forming part 30 and a fixing part 40 which are stored in the main housing 10.

On the front face of the main housing 10, a front cover 11 is provided, and on the rear face of the main housing 10, a rear cover 12 is provided. The rear cover 12 is opened at a sheet jamming or a maintenance work. On the top face of the main housing 10, a discharge part 13 is provided, to which a sheet with an image is discharged. In an inner space S formed by the front cover 11, the rear cover 12 and the discharge part 13, various devices performing image forming processing are stored.

The sheet feeding part 20 includes a sheet feeding cassette 21 in which the sheet on which the image is formed is stored. One portion of the sheet feeding cassette 21 is protruded more forward than the front face of the main housing 10. The upper face of the other portion of the sheet feeding cassette 21 stored in the main housing 10 is covered with a sheet feeding cassette top plate 21U. The sheet feeding cassette 21 is provided with a sheet storage space in which a bundle of the sheets is stored and a lift plate which lifts the sheet bundle for feeding. Above the rear end portion of the sheet feeding cassette 21, a sheet feeding part 21A is provided. The sheet feeding part 21A includes a sheet feeding roller 21B which feeds the uppermost sheet of the sheet bundle in the sheet feeding cassette 21 one by one.

The image forming part 30 performs the image forming processing for forming the image on the sheet fed from the sheet feeding part 20. The image forming part 30 includes a photosensitive drum 31, a charging device 32, an exposure device (not shown in FIG. 2), a development device 33, and a transferring roller 34 which are disposed around the photosensitive drum 31.

The photosensitive drum 31 includes a rotational shaft and a cylindrical face rotating around the rotational shaft. On the cylindrical face, an electrostatic latent image is formed and a toner image corresponding to the electrostatic latent image is carried. As the photosensitive drum 31, an OPC photosensitive drum may be used.

The charging device 32 charges the surface of the photosensitive drum 31 uniformly, and includes a scorotron disposed at a predetermined interval to the photosensitive drum 31 and discharging when applied with a predetermined voltage.

The exposure device includes a laser light source and an optical element such as a mirror or a lens, and emits light modulated based on an image data output from an external device, such as a personal computer, to the circumferential face of the photosensitive drum 31 to form the electrostatic latent image.

The development device 33 supplies the toner to the circumferential face of the photosensitive drum 31 in order to develop the electrostatic latent image into the toner image.

The transferring roller 34 transfers the toner image formed on the circumferential face of the photosensitive drum 31 to the sheet. The transferring roller 34 comes into contact with the cylindrical face of the photosensitive drum 31 to form a transferring nip area. To the transferring roller 34, a transferring bias having a reverse polarity to the toner is applied.

The fixing part 40 performs a fixing processing for fixing the transferred toner image on the sheet. The fixing part 40 includes a fixing roller 41 in which a heating source is stored, and a pressing roller 42 coming into pressure contact with the fixing roller 41. Between the fixing roller 41 and the pressing roller 42, a fixing nip area is formed. When the sheet to which the toner image is transferred is passed through the fixing nip area, the toner image is heated by the fixing roller 41 and pressed by the pressing roller 42, and then fixed on the sheet. In the present embodiment, a melt viscosity (Ps·s) of the nonmagnetic one-component toner used in the development device 33 at 95° C. is set within a range of 10,000 or more and 200,000 or less.

In the main housing 10, a main conveyance path 22F and an inversion conveyance path 22B are provided for conveying the sheet. The main conveyance path 22F extends from the sheet feeding part 21A of the sheet feeding part 20 to a discharge port 14 provided so as to face of the discharge part 13 on the top face of the main housing 10 via the image forming part 30 and the fixing part 40. The inversion conveyance path 22B is a conveyance path for conveying the sheet printed on one face to the upstream side of the image forming part 30 on the main conveyance path 22F when the both-face printing is performed on the sheet.

The main conveyance path 22F is formed through the transferring nip area between the photosensitive drum 31 and the transferring roller 34 from the lower side to the upper side. On the upstream side of the transferring nip area on the main conveyance path 22F, a registration rollers pair 23 is disposed. The sheet is stopped by the registration rollers pair 23, and then fed to the transferring nip area at a timing suitable for image transferring after the skew of the sheet is corrected. At suitable positions on the main conveyance path 22F and the inversion conveyance path 22B, a plurality of conveyance rollers for conveying the sheet is disposed, and a discharge rollers pair 24 is disposed near the discharge port 14, for example.

The inversion conveyance path 22B is formed between the outer side face of an inversion unit 25 and the inner face of the rear cover 12 of the main housing 10. The transferring roller 34 and one roller of the registration rollers pair 23 are mounted on the inner face of the inversion unit 25. The rear cover 12 and the inversion unit 25 are each rotatable around an axis of a fulcrum part 121 provided at their lower end portions. When a sheet jamming occurs in the inversion conveyance path 22B, the rear cover 12 is opened. When a sheet jamming occurs on the main conveying path 22F, or when the unit of the photosensitive drum 31 or the development device 33 is detached to the outside, the inversion unit 25 is also opened in addition to the rear cover 12.

Figure 2:
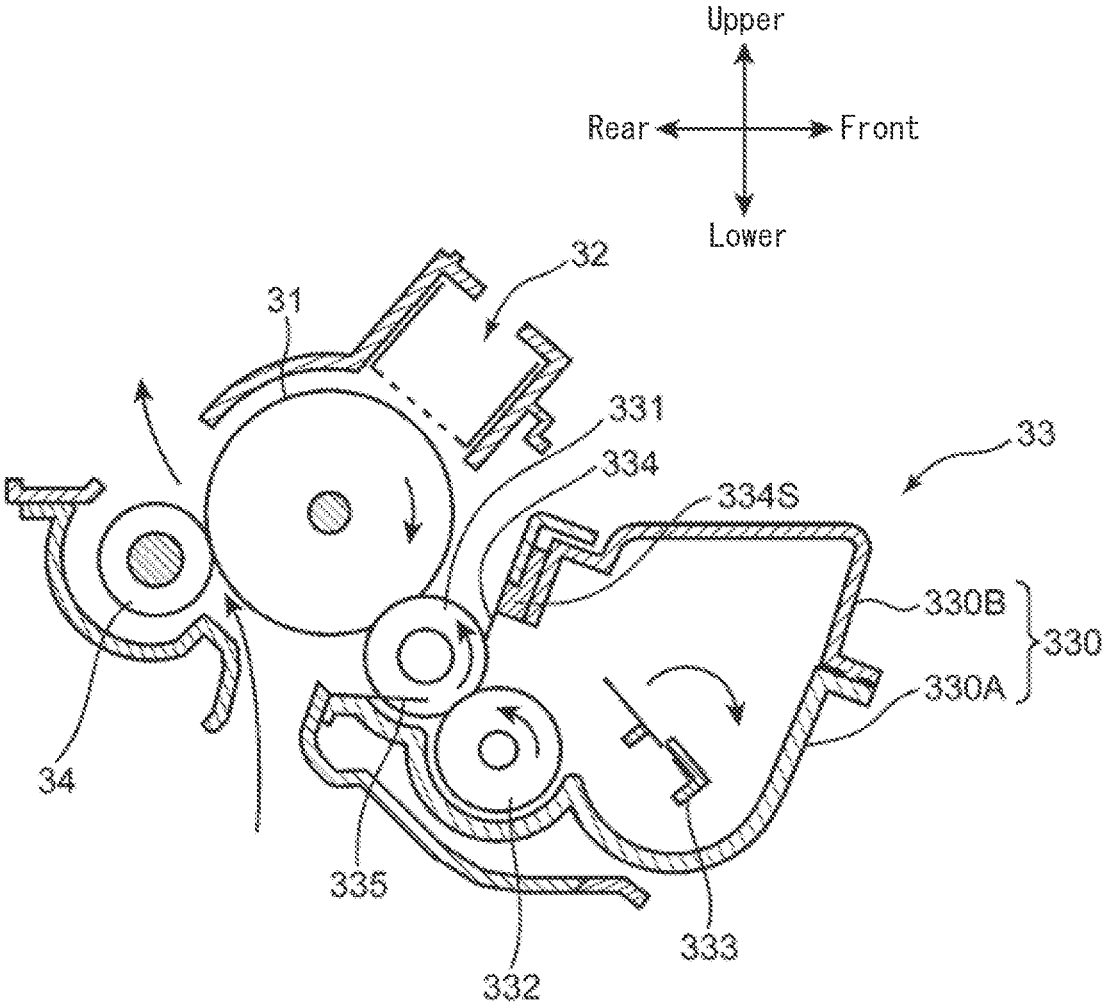
FIG. 2 is a sectional view showing a photosensitive drum and its periphery of the image forming apparatus according to the embodiment of the present disclosure.

FIG. 2 is a sectional view showing a structure around the photosensitive drum 31. In this embodiment, the transfer roller 34 is disposed so as to come into contact with the photosensitive drum 31 on the rear side of the photosensitive drum 31, and the charging device 32 is disposed so as to face the photosensitive drum 31 at a predetermined interval on the front and upper side of the photosensitive drum 31. The transferring nip area is formed between the photosensitive drum 31 and the transferring roller 34, and the sheet passes through the transferring nip area as indicated by the arrow in FIG. 2. At this time, the toner image is transferred from the photosensitive drum 31 to the sheet.

The development device 33 is disposed so as to face the photosensitive drum 31 on the front and lower side of the photosensitive drum 31. The development device 33 includes a development housing 330, a development roller 331, a supply roller 332, an agitating paddle 333, a regulating blade 334 (a layer thickness regulating member), and a lower seal 335 (a sealing member).

The development housing 330 stores the nonmagnetic one-component toner. The development housing 330 includes a housing main body 33A and a housing lid 330B. As shown in FIG. 2, in the rear end portion of the development housing 330, an opening for exposing a part of the development roller 331 to the photosensitive drum 31 is formed.

The development roller 331 is supported by the development housing 330 in a rotatable manner, and has a circumferential face on which the toner is carried. The development roller 332 comes into contact with photosensitive drum 31, and forms a development nip area together with the photosensitive drum 31 for supplying the toner to the photosensitive drum 31. The development roller 331 has a shaft made of SUS or SUM, and a cylindrical rubber layer (an elastic body) around the shaft. The rubber layer is made of NBR (Nitril-Butadiene rubber), for example. A predetermined coating layer may be formed around the rubber layer. In the present embodiment, an Asker-C hardness of the surface of the development roller 331 is set within a range of 50 or more and 80 or less.

The supply roller 332 is disposed so as to face the development roller 331 on the front and lower side of the development roller 331, and supported by the development housing 220 in a rotatable manner. The supply roller 332 comes into contact with the development roller 331, and forms a supply nip area for supplying the toner to the development roller 331. The supply roller 332 has a predetermined shaft (a shaft member) made of metal, and a cylindrical urethane sponge or foamed sponge (an elastic foamed member) fixed around the shaft. In the present embodiment, an Asker-FP hardness of the surface of the supply roller 332 is set within a range of 40 or more and 60 or less. A width of the supply nip area is set within a range of 0.2 mm or more and 1.5 mm or less in the rotational direction when viewed along the radial direction.

The agitating paddle 333 is supported by the development housing 330 in a rotatable manner on the front side of the supply roller 332. The agitating paddle 333 includes a shaft having a L-shaped cross section as shown in FIG. 2 and a PET film extending radially from the shaft.

FIG. 2 shows rotational directions of the development roller 331, the supply roller 332 and the agitating paddle 333 when the image forming processing to the sheet is performed in the image forming apparatus 1. The development roller 331 rotates such that its surface moves in the same direction as the surface of the photosensitive drum 31 at the development nip area. As an example, a circumferential speed ratio of the development roller 331 to the photosensitive drum 31 is set to 1.55. The supply roller 332 rotates such that its surface moves in a direction opposite to the surface of the development roller 331. A circumferential speed ratio of the development roller 331 to the supply roller 332 is set to 1.55. The agitating paddle 333 rotates so as to scoop the toner in the development housing 330 and to supply it to the supply roller 332.

The regulating blade 334 comes into contact with the surface (the circumferential face) of the development roller 331 on the downstream side of the supply nip area in the rotational direction of the development roller 331 and on the upstream side of the development nip area in the rotational direction of the development roller 331. The regulating blade 334 is fixed to the development housing 330 so as to be inclined toward the upstream side in the rotational direction of the development roller 331. The regulating blade 334 regulates a thickness (a layer thickness) of the toner on the development roller 331.

The lower seal 335 is supported by the housing main body 330A so as to close a gap between the development roller 331 and the housing main body 330A on a side opposite to the regulating blade 334. The tip end portion of the lower seal 334 comes into contact with the surface of the development roller 331.

In the present embodiment, as shown in FIG. 2, the so-called cleanerless configuration is adopted in which the charging device 32 is disposed on the downstream side of the photosensitive drum 31 in the rotational direction of the photosensitive drum 31 as viewed from the transferring nip area between the photosensitive drum 31 and the transferring roller 34, and a known cleaning device is not provided. That is, when the toner image is transferred from the photosensitive drum 31 to the sheet at the transferring nip area, the untransferred toner remains on the photosensitive drum 31. The untransferred toner passes through the charging device 32 and is collected from the photosensitive drum 31 by the development roller 331 of the development device 33. At this time, when the images (the toner images) are continuously formed on the sheet, the development roller 331 collects the untransferred toner from the photosensitive drum 31 and supplies the toner to the electrostatic latent image on the photosensitive drum 31.

On the other hand, the supply roller 332 supplies the new toner to the development roller 331 at the supply nip area and collects the toner not supplied to the photosensitive drum 31 from the development roller 331 from the development roller 331.

Figure 3:
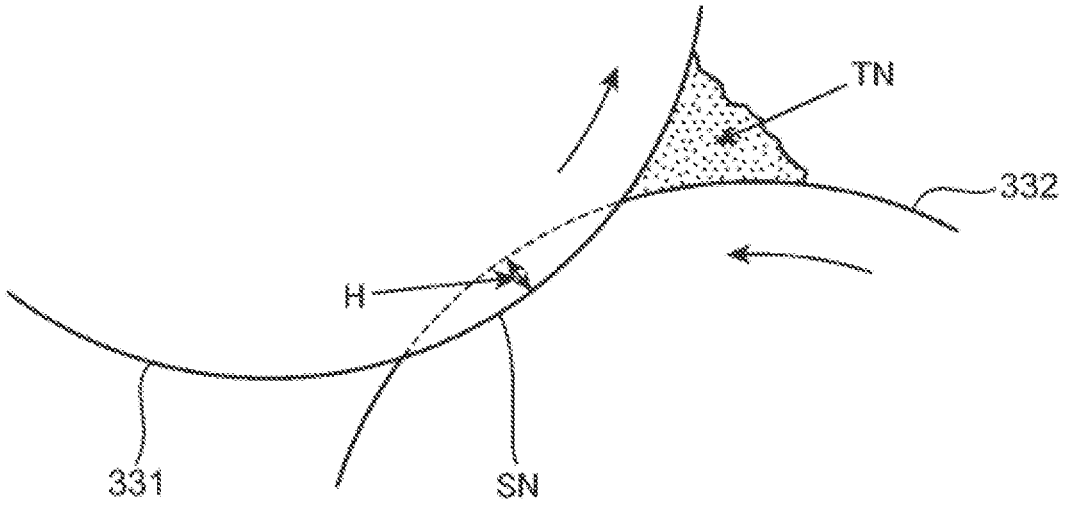
FIG. 3 is an enlarged sectional view showing a supply nip area between a development roller and a supply roller of a development device according to the embodiment of the present disclosure.

FIG. 3 is an enlarged sectional view showing an area where the development roller 331 faces the supply roller 332 in the development device 33 according to the embodiment of the present disclosure. In the embodiment, the shaft of the development roller 331 and the shaft of the supply roller 332 are supported by the development housing 330 such that the surface of the development roller 331 bites the surface of the supply roller 332 by a biting amount H. As a result, between the development roller 331 and the supply roller 332, a supply nip area SN having a predetermined width along their rotational directions is formed. Because the supply roller 332 has a hardness smaller than the development roller 331, as shown in FIG. 3, the surface of the supply roller 332 is mainly deformed to form the supply nip area SN. Therefore, when the development roller 331 and the supply roller 332 are rotated, the toner supplied by the supply roller 332 remains on the upstream side of the supply nip area SN, and a toner accumulation TN is formed. The toner accumulation TN allows to supply the toner from the supply roller 332 to the development roller 331 stably even if the high-density image is formed on the photosensitive drum 31.

On the other hand, when the development roller 331 and the supply roller 332 may come into point contact with each other in the sectional view, because the sufficient toner accumulation TN shown in FIG. 3 is not formed, a toner supply performance may be remarkably decreased.

Therefore, it is necessary to set a center distance (a shaft distance) between the development roller 331 and the supply roller 332 and their diameters so as to have an appropriate biting amount H. An asker-C hardness of the development roller 331 is set within a range of 50 or more and 80 or less because the development roller 331 comes into contact with the hard member such as the photosensitive drum 31. Accordingly, in order to have the configuration in which the development roller 331 bites the supply roller 332 as shown in FIG. 3, it is necessary to set a hardness of the supply roller 332 smaller than the development roller 331.

Here, the undeveloped toner on the development roller 331 remains (adheres) on the surface of the development roller 331 owing to image force, van der Waals force, liquid cross-linking force, and electric field energy. That is, by scraping the undeveloped toner with friction force larger than the above force, the supply roller 332 allows to collect the undeveloped toner from the development roller 331. The frictional force is a product of a friction coefficient and a load, and by setting a compression load, which is force for pressing the supply roller 332 against the development roller 331, to an optimum range, a collectability of the undeveloped toner is remarkably improved.

As a result of intensive experiments based on the above actions, the inventors of the present disclosure newly find that it is desirable that an electric resistance of the supply roller 332 is contained in a range of $1\times10^2\Omega$ or more and $1\times10^4\Omega$ or less and the supply roller 332 comes into contact with the circumferential face of the development roller 332 in a state where a compression load contained in a range of 0.2 N or more and 1.5 N or less is applied to the shaft (the shaft member) of the supply roller 331 in a direction perpendicular to the axial direction of the shaft. The above compressive load is also a load applied along a straight line connecting the rotational center of the development roller 331 and the rotational center of the supply roller 332 when viewed in a cross section perpendicular to the axial direction of the shaft.

Here, the toner is supplied from the supply roller 331 to the development roller 332 by an electric field energy, which is a potential difference between the development roller 332 and the supply roller 331, or van der Waals force. However, when the electric resistances of the development roller 311 and the supply roller 322 are high, an effective electric field between the development roller 331 and the supply roller 332 becomes small, and the supply performance deteriorates. Therefore, in order to maintain a charged amount of the toner and to ensure a developability of the toner from the development roller 331 to the photosensitive drum 31, it is desirable that an electric resistance of the development roller 331 is contained in the range of $1\times10^5\Omega$ or more and $1\times10^9\Omega$ or less. Then, in order to form an effective electric field capable of securing the supply performance of the toner from the supply roller 332 to the development roller 331 within the above range of the electric resistance of the development roller 331, an electric resistance of the supply roller 332 must be contained in the range of $1\times10^2\Omega$ or more and $1\times10^4\Omega$ or less. Furthermore, the inventors of the present disclosure newly find that by setting the compression load, which is the force for pressing the supply roller 332 against the development roller 331, to the optimum range as described above, the following performance of a solid image is remarkably improved.

According to the above configuration, since the resistance value of the supply roller 332 is contained in a range of $1\times10^2\Omega$ or more and $1\times10^4\Omega$ or less, it becomes possible to stabilize the toner supply performance from the supply roller 332 to the development roller 331. Further, since the compression load applied on the axial center (the center of the shaft) of the supply roller 332 in the orthogonal direction is set to 0.2 N or more, the toner supply performance from the supply roller 332 to the development roller 331 can be further stabilized. As a result, it is possible to reduce the image failures such as insufficiency of the image density and density unevenness when the solid images are continuously printed. In order to suppress a significant increasing of the driving torque for rotating the supply roller 332, it is desirable to set the compression load to 1.5 N or less. Further, as described above, by managing the compression load of the supply roller 332 to the development roller 331, it is possible to stably maintain the toner supply performance because the influence of the roller diameters of the development roller 331 and the supply roller 332 and the hardness of each roller is small.

Further, in the embodiment, it is desirable that the Asker-C hardness of the development roller 331 is set to a range of 50 or more and 80 or less and a width of the supply nip area between the development roller 331 and the supply roller 332 in the rotational direction is set to a range of 0.2 mm or more and 1.5 mm or less. For example, the width of the supply nip area is obtained by measuring a width of the nip area when the supply roller 332 comes into contact with a cylinder made of polycarbonate assuming the shape and the hardness of the development roller 331.

According the configuration, it becomes possible to stably maintain the supply performance of the toner from the supply roller 332 to the development roller 331 and to suppress occurrence of the image density unevenness. As a result, it becomes possible to decrease the image failures such as the insufficiency of the image density and the density unevenness when the solid images are continuously printed.

Further, it is preferable that the Asker-HP hardness of the surface of the supply roller 332 is set in a range of 40 or more and 60 or less. When the Asker-FP hardness of the supply roller 332 exceeds 60, the drive torque for rotating the supply roller 332 is significantly increased because the hardness of the supply roller 332 is too high. When the Asker-FP hardness of the supply roller 332 is less than 40, the flow of the toner in the supply nip area between the development roller 331 and the supply roller 332 becomes unstable. In particular, since the hardness of the supply roller 332 is too low, the old toner collected from the photosensitive drum 31 to the development roller 331 easily passes through the supply nip area SN and is again supplied from the supply roller 332 to the development roller 331. Therefore, it becomes difficult to supply a sufficient amount of the new toner from the supply roller 332 to the development roller 331, and the image failures such as the insufficiency of image density and the density unevenness are easily induced when the solid images are continuously printed.

Further, it is preferable that a melt viscosity (Pa·s) of the nonmagnetic one-component toner used in the development device 33 at 95° C. is set in a range of 10,000 or more and 200,000 or less. Even if the toner has a relatively low melt viscosity and its viscosity is easily increased depending on the temperature in the apparatus, it becomes possible to stably maintain the supply of the toner to the development roller 331 by the supply roller 332 and to reduce the image failures such as the insufficiency of the image density and the density unevenness when the solid images are continuously printed.

As described above, the electric resistance of the development roller 331 is preferably contained in a range of $1\times10^5\Omega$ or more and $1\times10^9\Omega$ or less. When the electric resistance of the development roller 331 is less than $1\times10^5\Omega$, the charge of the toner carried on the development roller 331 is easily removed, and the toner fogging is easily generated when forming the image under a high humidity environment. When the electric resistance of the development roller 331 exceeds $1\times10^9\Omega$, the electric field formed between the development roller 331 and the photosensitive drum 31 is weakened, and the problem of low image density (thin image density) is likely to occur.

Example

Next, a preferable specification of the development device 33 will be described based on the examples. The following experiments were carried out in the following condition.

Experiment Condition

The photosensitive drum 31: an OPC drum,
A circumferential speed of the photosensitive drum 31: 118 m/sec,
A circumferential speed of the development roller 331: 182 mm/sec,
A circumferential speed ratio of the development roller 331 to the photosensitive drum 31: 1.55,
A DC component of the development bias: 350V,
A DC component of the supply bias: 450 V,
The surface potential of the photosensitive drum 31: 640V,
The Asker-C hardness of the development roller 331: 70, A diameter of the photosensitive drum 31: 24 mm, and An average particle diameter of the nonmagnetic toner: 8 μm (D50).

Table 1 shows detail conditions and experimental result of each example and comparative examples.

TABLE 1

| | DIAMETER OF SUPPLY ROLLER (mm) | WIDTH OF SUPPLY ROLLER (mm) | ELECTRIC RESISTANCE (Ω) | COM-PRESSION LOAD (N) | Asker-FP HARD-NESS | MELT VISCOSITY (PA · S) | DENSITY UNEVEN-NESS | TORQUE |
|---|---|---|---|---|---|---|---|---|
| Ex. 1 | 13.0 | 240.0 | $1 \times 10^3$ | 1.0 | 50 | 150000 | ◎ | ◎ |
| Ex. 2 | 15.0 | 240.0 | $1 \times 10^3$ | 1.0 | 50 | 150000 | ◎ | ○ |
| Ex. 3 | 11.0 | 240.0 | $1 \times 10^3$ | 1.0 | 50 | 150000 | ○ | ◎ |
| Ex. 4 | 13.0 | 120.0 | $1 \times 10^4$ | 1.0 | 50 | 150000 | ◎ | ◎ |
| Ex. 5 | 13.0 | 240.0 | $1 \times 10^2$ | 1.0 | 50 | 150000 | ○ | ◎ |
| Ex. 6 | 13.0 | 240.0 | $1 \times 10^4$ | 1.0 | 50 | 150000 | ○ | ◎ |
| Ex. 7 | 13.0 | 240.0 | $1 \times 10^3$ | 0.2 | 50 | 150000 | ○ | ◎ |
| Ex. 8 | 13.0 | 240.0 | $1 \times 10^3$ | 1.5 | 50 | 150000 | ◎ | ○ |
| Ex. 9 | 13.0 | 240.0 | $1 \times 10^3$ | 1.0 | 40 | 150000 | ◎ | ◎ |
| Ex. 10 | 13.0 | 240.0 | $1 \times 10^3$ | 1.0 | 60 | 150000 | ◎ | ○ |
| Ex. 11 | 13.0 | 240.0 | $1 \times 10^3$ | 1.0 | 50 | 100000 | ◎ | ◎ |
| Ex. 12 | 13.0 | 240.0 | $1 \times 10^3$ | 1.0 | 50 | 200000 | ◎ | ◎ |
| Comp. Ex. 1 | 13.0 | 240.0 | $5 \times 10^4$ | 1.0 | 50 | 150000 | X | ◎ |
| Comp. Ex. 2 | 13.0 | 240.0 | $1 \times 10^3$ | 0.1 | 50 | 150000 | X | ◎ |
| Comp. Ex. 3 | 13.0 | 240.0 | $1 \times 10^3$ | 1.6 | 50 | 150000 | ◎ | X |
| Comp. Ex. 4 | 13.0 | 240.0 | $1 \times 10^3$ | 1.0 | 35 | 150000 | X | ◎ |
| Comp. Ex. 5 | 13.0 | 240.0 | $1 \times 10^3$ | 1.0 | 65 | 150000 | ◎ | X |

In Examples 1 to 12 and Comparative Examples 1 to 5, when the diameter (mm) of the supply roller 332, the width (mm) of the supply roller 332 in the axial direction, the compression load (N) applied to the shaft of the supply roller 332 toward the development roller 331, the Asker-FP hardness of the supply roller 332 and the melt viscosity (Pa·s) of the toner are respectively changed, the image density unevenness and the torque applied to the development device 33 are evaluated.

The compression load was measured for the supply roller 332 alone using the FGC-1 manufactured by Nidec Corporation. In addition, the Asker-FP hardness of the supply roller 332 was measured for the supply roller 332 alone using the Asker-FP hardness meter manufactured by KOBUNSHI KEIKI Co., Ltd. The melt viscosity of 1 g of the toner was measured using the CFT-500D manufactured by Shimadzu Corporation.

The image density unevenness was evaluated using a difference in image density of a solid image between the leading end and the trailing end of the sheet (the paper). When the difference is less than 0.1, it is represented by ◎. When the difference is 0.1 or more but less than 0.2, it is represented by ○. When the difference is 0.2 or more, it is represented by x. Further, the torque of the development device 33 was evaluated for a development unit alone. When the torque is less than 250 mN·m, it is represented by ◎. When the torque is 250 mN·m or more or less than 300 mN·m, it is represented by ○. When the torque is 300 mN·m or more, it is represented by x.

As shown in Examples 1 to 12 of Table 1, when the electric resistance of the supply roller 332 is set in a range of $1\times10^2\Omega$ or more and $1\times10^4\Omega$ or less, by setting the compression load applied to the supply roller 332 in a range of 0.2 N or more and 1.5 N or less, the image density unevenness and the torque are satisfactory. In this case, since the toner can be stably supplied from the supply roller 332 to the development roller 331, the toner supply can sufficiently follow the high-density image formation, and the occurrence of the uneven image density is suppressed. In addition, since the supply roller 332 is not excessively pressed on the development roller 331, a large torque is prevented from being applied to the drive system for rotating the development roller 331, the supply roller 332 and the agitating paddle 333 of the development device 33. At this time, it was confirmed that the image density unevenness and the torque were good under the conditions that the width of the supply roller 332 in the axial direction was contained in a range of 120 mm or more and 240 mm or less, the Asker-FP hardness of the supply roller 332 was contained in a range of 40 or more and 60 or less, and the melt viscosity (Pa·s) of the toner at 95° C. was contained in a range of 10,000 or more and 200,000 or less.

On the other hand, in Comparative Example 1, since the electric resistance of the supply roller 332 is as high as $5\times10^4\Omega$, the supply of the toner from the supply roller 332 to the development roller 331 is insufficient, resulting in the occurrence of the image density unevenness. Similarly, in Comparative Example 2, since the compression load applied to the supply roller 332 is as low as 0.1 N, the supply of the toner from the supply roller 332 to the development roller 331 is insufficient, resulting in the occurrence of the uneven image density. On the other hand, in Comparative Example 3, since the compression load applied to the supply roller 332 is as high as 1.6 N, a large torque is applied to the drive system for rotating the development roller 331, the supply roller 332 and the agitating paddle 333 of the development device 33. In Comparative Example 4, since the Asker-FP hardness of the supply roller 332 is set as low as 35, the toner supply performance of the supply roller 332 becomes insufficient, resulting in the occurrence of the image density unevenness. In Comparative Example 6, since the Asker-FP hardness of the supply roller 332 is as high as 65, the frictional force between the development roller 331 and the supply roller 332 is high, and a large torque is applied to the drive system for rotating the development roller 331, the supply roller 332 and the agitating paddle 333 of the development device 33.

The same evaluation result (effect) as described above was reproduced in a range in which the diameter of the development roller 331 was not less than 11.0 mm and not more than 15.0 mm. Similarly, the same evaluation result (effect) as described above was reproduced in a range of 1.3 or more and 1.8 or less in which the circumferential speed ratio between the development roller 331 and the supply roller 332 (the circumferential speed of the development roller 331 is higher than that of the supply roller).

Although the development device 33 according to the present embodiment and the image forming apparatus 1 including the development device have been described above, the present disclosure is not limited thereto, and for example, the following modified embodiment can be employed.

(1) In the above embodiment, the image forming apparatus 1 is provided with one development device 33, but the image forming apparatus 1 may be a color image forming apparatus having development devices 33 corresponding to a plurality of colors.

(2) In the embodiment described above, the development housing 330 of the development device 33 stores the nonmagnetic toner therein, but the development device may have a toner container and a toner cartridge for storing the nonmagnetic toner in addition to the development housing 330.

The invention claimed is:

1. A development device comprising:

a development housing in which a nonmagnetic one-component toner is stored;

a development roller formed by a cylindrical elastic body, supported by the development housing in a rotatable manner, disposed so as to face a photosensitive drum at a development nip area, and having a circumferential face on which the toner is carried;

a supply roller including a metal shaft member and a cylindrical foamed elastic body provided around the shaft member, supported by the development housing in a rotatable manner, coming into contact with the circumferential face of the development roller to form a supply nip area between the supply roller and the development roller, supplying the toner to the development roller and collecting the toner from the development roller; and a layer thickness regulating member coming into contact with the circumferential face of the development roller on a downstream side of the supply nip area in a rotational direction of the development roller and regulating a thickness of the toner on the development roller, wherein the supply roller has an electric resistance within a range of $1\times10^2\Omega$ or more and $1\times10^4\Omega$ or less, and the supply roller comes into contact with the circumferential face of the development roller in a state where a compression load within a range of 0.2 N or more and 1.5 N or less is applied to the shaft member of the supply roller in a direction perpendicular to an axial direction of the shaft member.

2. The development device according to claim 1, wherein the supply roller has an Asker-FP hardness within a range of 40 or more and 60 or less.

3. The development device according to claim 1, wherein the toner has a melt viscosity (Pa·s) at 95° C. within a range of 10,000 or more and 200,000 or less.

4. The development device according to claim 1, wherein the devilment roller has an Asker-C hardness within a range of 50 or more and 80 or less.

5. The development device according to claim 1, wherein the supply nip area between the development roller and the supply roller has a width within a range of 0.2 mm or more and 1.5 mm or less in the rotational direction of the development roller.

6. An image forming apparatus comprising:

the development device according to claim 1; and the photosensitive drum having a surface on which an electrostatic latent image is formed, and to which the toner is supplied from the development roller.

* * * * *